US005457310A

United States Patent [19]

Fournier

[11] Patent Number: 5,457,310

[45] Date of Patent: Oct. 10, 1995

[54] METHOD AND SYSTEM FOR AUTOMATICALLY CORRECTING BORESIGHT ERRORS IN A LASER BEAM GUIDANCE SYSTEM

[75] Inventor: Gerald R. Fournier, Dallas, Tex.

[73] Assignee: Varo Inc., Garland, Tex.

[21] Appl. No.: 140,240

[22] Filed: Oct. 20, 1993

[51] Int. Cl.[6] ..... H01J 40/14

[52] U.S. Cl. ..... 250/206.2; 356/152.1

[58] Field of Search ..... 250/203.1, 203.2, 250/206.1, 206.2; 356/1, 5, 141, 152.1, 152.2, 152.3; 244/3.13, 3.16

[56] References Cited

U.S. PATENT DOCUMENTS

| | | | |
|---|---|---|---|
| 3,470,377 | 9/1969 | LeFebre et al. | 250/203.2 |
| 3,603,686 | 9/1971 | Paine et al. | 250/203.2 |
| 4,384,198 | 5/1983 | Williamson | 250/203.1 |
| 4,385,834 | 5/1983 | Maxwell, Jr. | 356/153 |
| 4,407,464 | 10/1983 | Linick | 244/3.13 |
| 4,422,758 | 12/1983 | Godfrey et al. | 356/152.1 |
| 4,798,462 | 1/1989 | Byren | 356/152 |
| 4,902,128 | 2/1990 | Siebecker et al. | 356/152.1 |
| 4,977,361 | 12/1990 | Phillips, et al. | 318/640 |
| 5,045,678 | 9/1991 | Esser et al. | 250/201.1 |
| 5,045,679 | 9/1991 | Suzuki et al. | 250/201.1 |
| 5,065,005 | 11/1991 | Encaoua et al. | 250/206.2 |

*Primary Examiner*—Stephone B. Allen
*Attorney, Agent, or Firm*—Baker & Botts

[57] ABSTRACT

A method and system is provided for automatically maintaining the position of a laser beam relative to a boresight axis with a highly sensitive and selective beam position detector that is optimally located for noise reduction, and compensating for angular errors by displacing the laser beam directly and thereby minimizing tracking errors.

9 Claims, 9 Drawing Sheets

54LS161
U10
CK
Co
CL
QA
QB
QC
QD
+5V
54LS153
U11
U12
1Y
SEL B
SEL A
54LS08
U13A
U13B
U13C
U13D
U15B
CK
Q
D
PR
54LS74
U3D
Y FAST
MCL 3
U14B
SAMPLE GATE
P19
X PHASE A
X PHASE B
U16A
U16B
U17A
U17B
54LS86
54LS175
MCL 1
U16C
U18A
U18B
U18C
X MOTOR GATE
U19A
U19B
U17C
U17D
Y PHASE B
Y PHASE A
MCL 4
U19C
U20A
U20B
U20C
Y MOTOR GATE
X MOTOR ENABLE
Y MOTOR ENABLE
FROM FIG. 5a

METHOD AND SYSTEM FOR AUTOMATICALLY CORRECTING BORESIGHT ERRORS IN A LASER BEAM GUIDANCE SYSTEM

TECHNICAL FIELD OF THE INVENTION

This invention relates generally to optical beam guidance systems, and more particularly, to a method and system for automatically correcting boresight errors in a laser beam guidance system.

BACKGROUND OF THE INVENTION

Laser beam guidance systems are used to align a laser beam with an optical boresight, in order to direct the beam to a selected target. Typically, a designated target is viewed through the boresight, and the laser beam is directed to illuminate the target. The reflection of the illumination may be used to guide a weapon to the target. In such a guidance system, the axis of the laser beam must be precisely aligned with the boresight axis, otherwise target designation errors will occur that significantly degrade the accuracy of the weapons delivery system.

One approach to aligning a laser beam with a boresight is described in U.S. Pat. No. 4,385,834, which issued on May 31, 1983 to Richard F. Maxwell, Jr. Maxwell describes a laser beam boresight system that aligns a laser beam's axis with an imaging sensor's viewing axis. The imaging sensor's viewing axis is used as one reference axis. A second laser beam's axis, which is fixed with respect to the first laser beam's axis, is aligned with an electromagnetic source beam axis. A light emitting diode is used as the electromagnetic source. The electromagnetic source beam axis is used as a second reference axis. The first reference axis is fixed with respect to the second reference axis. The angular displacement between the second laser beam's axis and the two, reference axes is detected, and error signals are generated by the detector which are proportional to the angular displacement. The error signals are used to correct the angular displacement, in order to align the second laser beam with the reference beam axes. If the system is properly aligned, the image of the reference source beam in the sensor's display will represent the target at which the first laser beam is directed. However, Maxwell's use of multiple laser beams increases the technical complexity and cost of such a system. An increase in the complexity of such a system is accompanied by a decrease in system accuracy. Furthermore, since the detection of the angular displacement between the second laser beam's axis and the two, reference axes is accomplished at a significant distance from the laser source, a significant amount of noise is generated at the detection stage, which introduces additional errors that further decrease the accuracy of the system. Accordingly, a need exists in the laser beam guidance manufacturing industry for a less complex but more accurate, automatic boresight alignment system.

SUMMARY OF THE INVENTION

In accordance with the present invention, a method and system is provided for automatically maintaining the position of a laser beam relative to a boresight axis by using a highly sensitive and selective beam position detector that is optimally located for noise reduction, and compensating for angular errors by displacing the laser beam directly and thereby minimizing tracking errors.

An important technical advantage of the present invention is that accurate laser beam positioning may be accomplished with relatively minimal complexity and cost. Another important technical advantage of the invention is that noise generated during the detection phase may be minimized, which significantly increases the overall accuracy and response time of the system.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiment of the present invention and its advantages are best understood by referring to FIGS. 1–7 of the drawings, like numerals being used for like and corresponding parts of the various drawings.

Figure 1A:
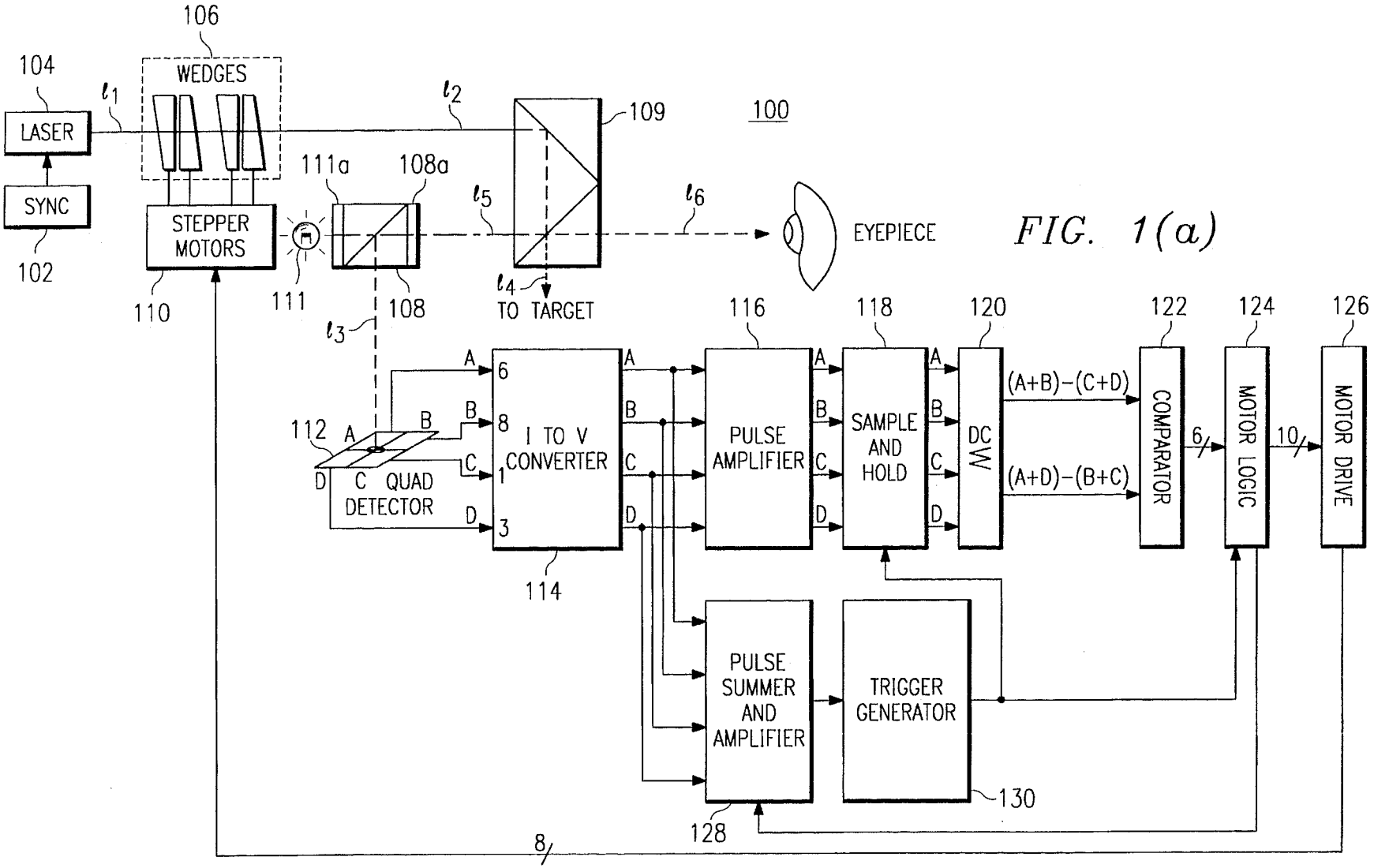
FIGS. 1(*a*)–(*b*) illustrate a block diagram of a system for automatically correcting boresight errors in a laser guidance system and a beam splitter assembly in accordance with a preferred embodiment of the present invention.
Figure 1B:
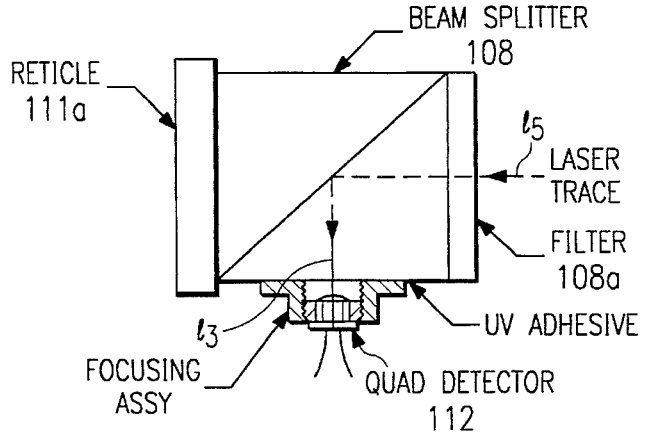

FIG. 1(*a*) illustrates a block diagram of a system for automatically correcting boresight errors in a laser guidance system in accordance with a preferred embodiment of the present invention. Pertinent details of the beam splitter assembly in FIG. 1(*a*) are shown in FIG. 1(*b*). Referring to FIGS. 1(*a*) and 1(*b*), synchronization pulse generator 102 provides the timing pulse for laser source 104, which generates laser beam l1 having a pulse width of 17 nanoseconds and operating at a repetition rate of about 20 Hz. Although the preferred embodiment is directed to a laser beam guidance system, the invention is not intended to be so limited, and may include guidance of any beam operating in the optical frequency band. Beam l1 passes through optical wedges 106 and may be angularly displaced by the positioning of the optical wedges. The displaced beam is designated as l2. Beam guidance is controlled by counter-rotating the two pairs of optical wedges 106, whereby one pair of wedges operates to position the beam in the vertical plane and the other pair of wedges positions the beam in the horizontal plane. Each wedge is mounted in the center of a Delrin gear (not explicitly shown). Each gear is driven by a pinion mounted on the shaft of a stepper motor located in stepper motor assembly 110. In the preferred embodiment, the pinion to gear ratio is 5:1, which provides increased torque to position the wedge along with greater incremental control and resolution (i.e., more incremental positioning steps). A first portion of beam 12 (≈99% of the light energy) passes through optical prism 109 and is directed toward the designated target (not explicitly shown) as beam 14, while a second portion of beam 12 (≈1% of the light energy) is reflected towards beam splitter 108 as beam 15. To form a reference reticle image, light source 111, which may be any appropriate source of light energy, generates a beam of light that passes through reticle 111*a*, beam splitter 108 and optical prism 109, and is directed to the eyepiece as beam 16. A design objective is to structure a projected reticle and quad detector, which have a common optical axis and apparent focal point for tracking the laser spot relative to the aim mark. Quad detector 112 and reticle 111*a* are protected from raw designator power by optical filter 108*a* on a surface of beam splitter 108. Consequently, a viewer at the eyepiece of the reticle may view the designated target. A direct path between reticle light source 111 and the reticle eyepiece is designated as the boresight axis. Additionally, a portion of beam 15 is passed through beam splitter 108 and reflected toward quad detector 112. Essentially, the invention functions to maintain the coaxial relationship between the boresight axis and the axis of the reflected laser beam, which may then be coincident with the axis of beam 15. Therefore, in accordance with the teachings of the present invention, upon detecting an angular displacement or error of beam 13 at quad detector 112 (i.e., a misalignment of the laser beam's axis with the boresight axis), system 100 automatically compensates for the error by operating optical wedges 106 to adjust the angular displacement of beam 12 and thereby minimize the displacement at the detector, which functions to adjust the angular displacement of beam 15 accordingly to realign the laser beam's axis coincidentally with the boresight axis.

Figure 2:
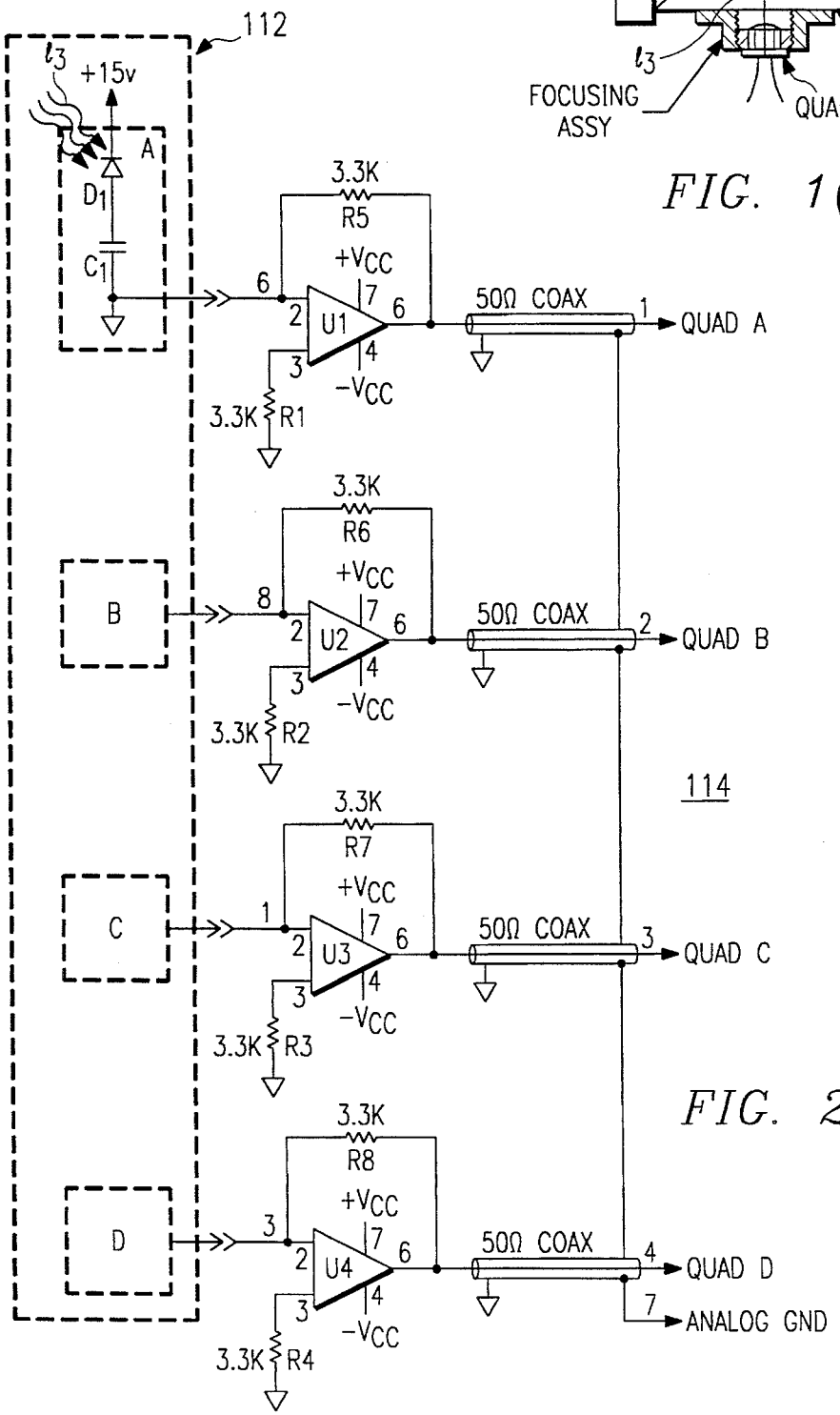
FIG. 2 illustrates an electrical schematic circuit diagram of the detector and transimpedance amplifier stages shown in FIG. 1.

FIG. 2 shows a schematic circuit diagram of the quad detector and transimpedance amplifier stages shown in FIGS. 1(*a*) and 1(*b*). Quad detector 112 may include four, identical silicon semiconductor photodetectors A–D. For the purposes of this discussion, only detector A will be described in detail, since it's structure and operation are identical to those of each of the other detectors B–D in assembly 112. For example, detector A includes light-sensitive diode D1 and capacitor C1. The light energy from beam 13 impinges on diode D1, and a charge is developed over time in capacitor C1. The resulting signal from detector 112A is coupled through input connection 6 to a signal input of transimpedance amplifier U1. Each detector 112A–D has a photosensitive area of 1.5 mm×1.5 mm per cell. The gap between cells may be 10 microns, which is much smaller than the 50 micron spot formed by laser beam 13. Consequently, the minimum tracking error produced by each detector 112A–D will be significantly low. To minimize front-end noise pick up, detectors 112A–D are mounted directly to an electrical connector to form quad detector assembly 112, which is mated to an input connector on current-to-voltage converter stage 114.

Current-to-voltage converter stage 114 includes four, identical transimpedance amplifiers U1–U4 and their associated circuitry. Each of amplifiers U1–U4 is a high speed, wide-band, current feedback operational amplifier having a low output impedance and capable of driving a 50 ohm load. The outputs of amplifiers U1–U4 are coupled by 50 ohm coax cables to respective inputs of pulse amplifier stage 116 and pulse summer and amplifier stage 128. By mounting each transimpedance amplifier in close proximity to its respective detector, transimpedance amplifier stage 114 operates as a preamplifier assembly to amplify the low level input signals from detectors 112A–D while minimizing front end noise pick up.

Figure 3:
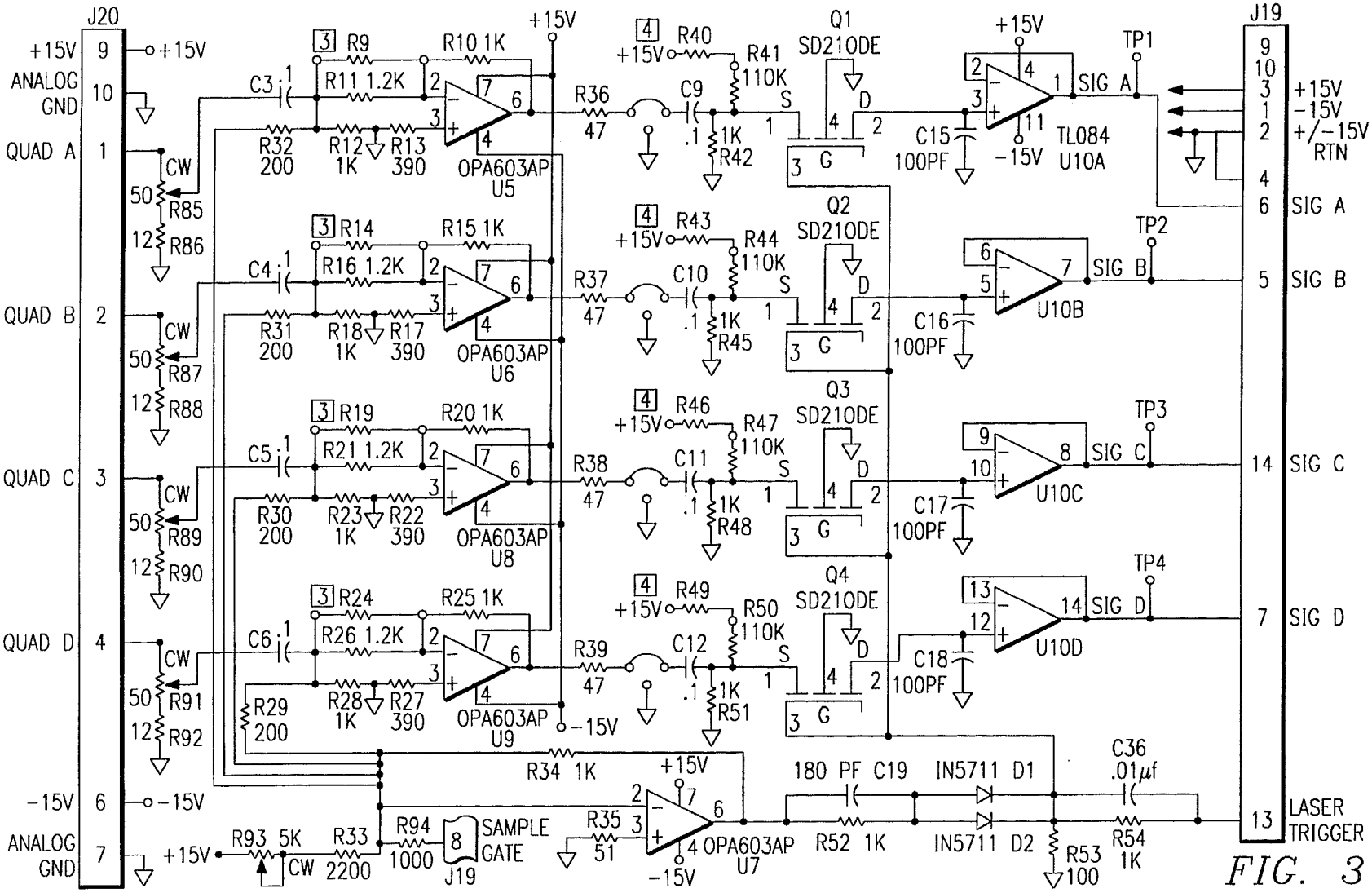
FIG. 3 illustrates an electrical schematic circuit diagram of the pulse amplifier, pulse summer and amplifier, and sample and hold stages shown in FIG. 1.

FIG. 3 illustrates an electrical schematic circuit diagram of the pulse amplifier, pulse summer and amplifier, and sample and hold stages shown in FIG. 1(*a*). Generally, the circuitry depicted in FIG. 3 contains four, identical signal processing channels and a trigger pulse generator, which develops the basic trigger pulse for timing the digital circuits in the system. Since the structure and operation of these four signal processing channels are identical, only "channel A" will be described in detail, it being understood that the description applies equally to each of the four channels. Specifically, the input signal "Quad A" from transimpedance amplifier U1 is developed across potentiometer R85, which may be adjusted in conjunction with corresponding potentiometers R87, R89 and R91 to balance the four channels. The input signal developed across R85 is coupled to the negative signal input of amplifier U5, and also to the negative signal input of operational amplifier U7. The signal at the output of amplifier U5 is inverted and coupled to the source of enhancement mode FET Q1. The output signal from amplifier U7 is coupled to the gate of FET Q1 and also to laser trigger output connection 13. The output signal from amplifier U7 is used as the trigger pulse for timing the operations of the digital circuits in the system and also providing a gate pulse for controlling the timing of the conduction of enhancement mode FET Q1. The output signal at the drain of FET Q1 is developed across holding capacitor C15 and coupled to the positive signal input of output source follower U10A, which operates as an output buffer stage for the preamplifier assembly. The output connection of source follower U10A is coupled to the channel A output connection of transimpedance amplifier stage 114.

The gate pulse for controlling the conduction of FETs Q1–Q4 is developed by summing the outputs of amplifiers U5–U9 across resistors R29–R34 with a DC offset voltage developed across potentiometer R93. The resulting signal at the output of amplifier U7 is clipped by diodes D1 and D2 and their associated circuits to provide a positive-going pulse having a slightly smaller pulse width than the 17 nanosecond pulse width of the signal from laser beam 13.

The primary purpose of the signal inverter, enhancement mode FET, holding capacitor, and output source follower circuits in each of the four processing channels is to provide sample and hold circuits for each channel. Since the laser signal derived from beam 13 has a pulse width of only 17 nanoseconds, it is preferable to sample the input signal and store it for a processing period of about 42.5 milliseconds (i.e., for a period just less than the 50 milliseconds between laser pulses). Consequently, the signal coupled to the gates of FET's Q1–Q4 causes the FETs to turn on in synchronization with each laser pulse in beam 13. This DC level at the drains of the FETs is held by capacitor C15 for the aforementioned 42.5 millisecond processing period. In the preferred embodiment, the time needed to process the detected laser signals and provide corresponding drive signals to position the optical wedges may be within the 42.5 millisecond processing period. The output signals A–D from the four channels shown in FIG. 3 are DC voltages that represent the magnitudes of the light beams sensed by each of the respective photosensitive detectors.

Figure 4:
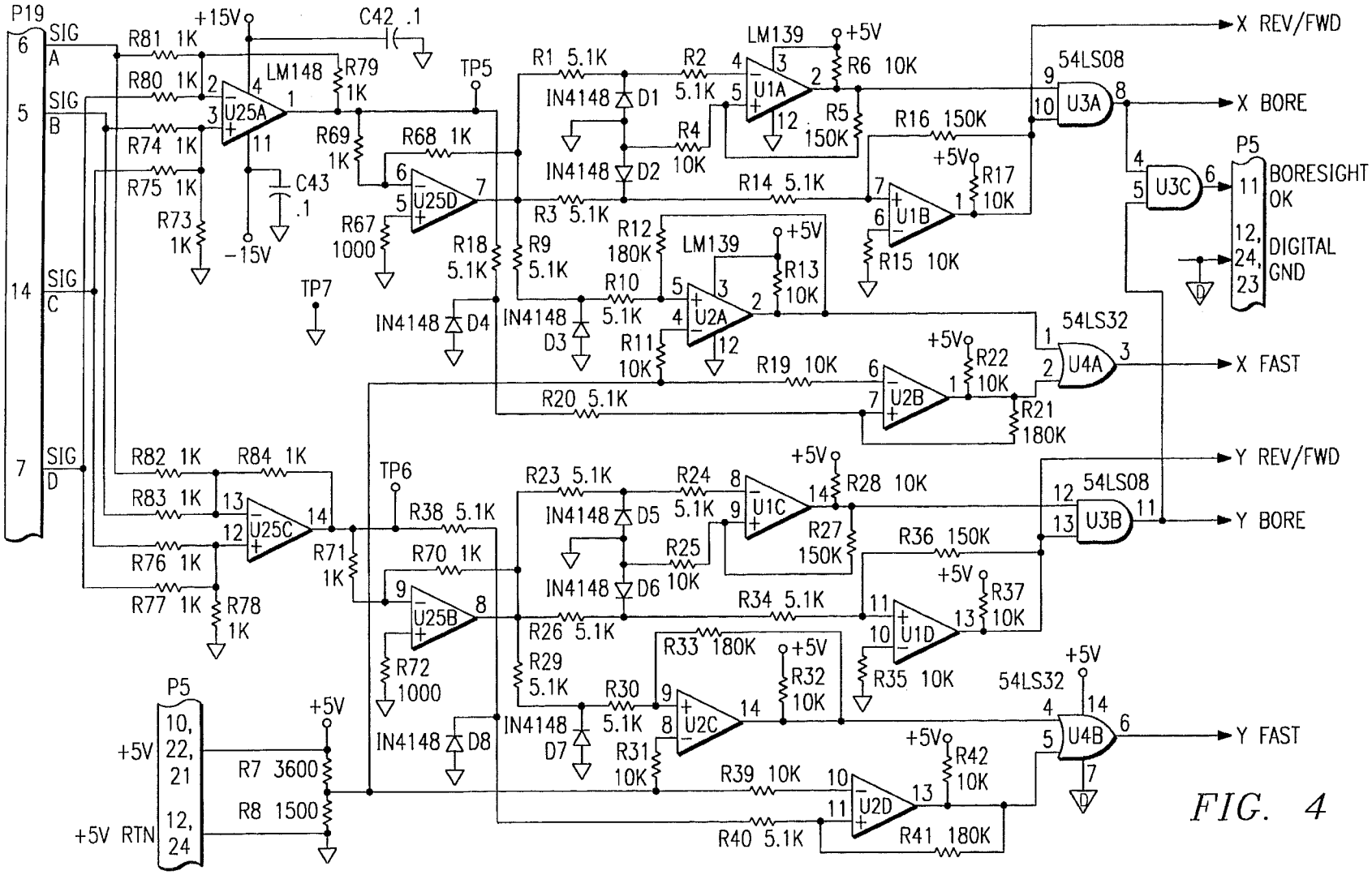
FIG. 4 illustrates an electrical schematic circuit diagram of the DC summer and comparator stages shown in FIG. 1.

FIG. 4 illustrates an electrical schematic circuit diagram of the DC summer and comparator stages shown in FIG. 1(*a*). Generally, the four DC voltage signals A–D from the outputs of source followers U10A–D are decoded into x and y positional information (Cartesian Coordinate System) using sum and difference amplifiers. This positional information is then converted into digital signals using a comparator circuit. Specifically, DC voltage signal A from the output of amplifier U10A is coupled to the negative signal inputs of amplifiers U25A and U25C, signal B is coupled to the positive signal input of amplifier U25A and the negative signal input of amplifier U25C, signal C is coupled to the positive signal inputs of amplifiers U25A and U25C, and signal D is coupled to the negative signal input of amplifier U25A and the positive signal input of amplifier U25C. The output signal from amplifier U25A is coupled to the negative signal input of amplifier U25D and the positive signal input of amplifier U2B. The output signal from amplifier U25C is coupled to the negative signal input of amplifier U25B and the positive signal input of amplifier U2D. The output of amplifier U25D is coupled to the negative input of comparator U1A, and the positive inputs of comparators U1B and U2A. The output of amplifier U25B is coupled to the negative input of comparator U1C, and the positive inputs of comparators U1D and U2C. The outputs of comparators U1A and U1B are coupled to respective inputs of AND gate U3A, while the outputs of comparators U2A and U2B are coupled to respective inputs of OR gate U4A.

Similarly, the outputs of comparators U1C and U1D are coupled to respective inputs of AND gate U3B, while the outputs of comparators U2C and U2D are coupled to respective inputs of OR gate U4B. The six positional signals output from comparator 122 are coupled to motor logic circuit 124.

Figure 5A:
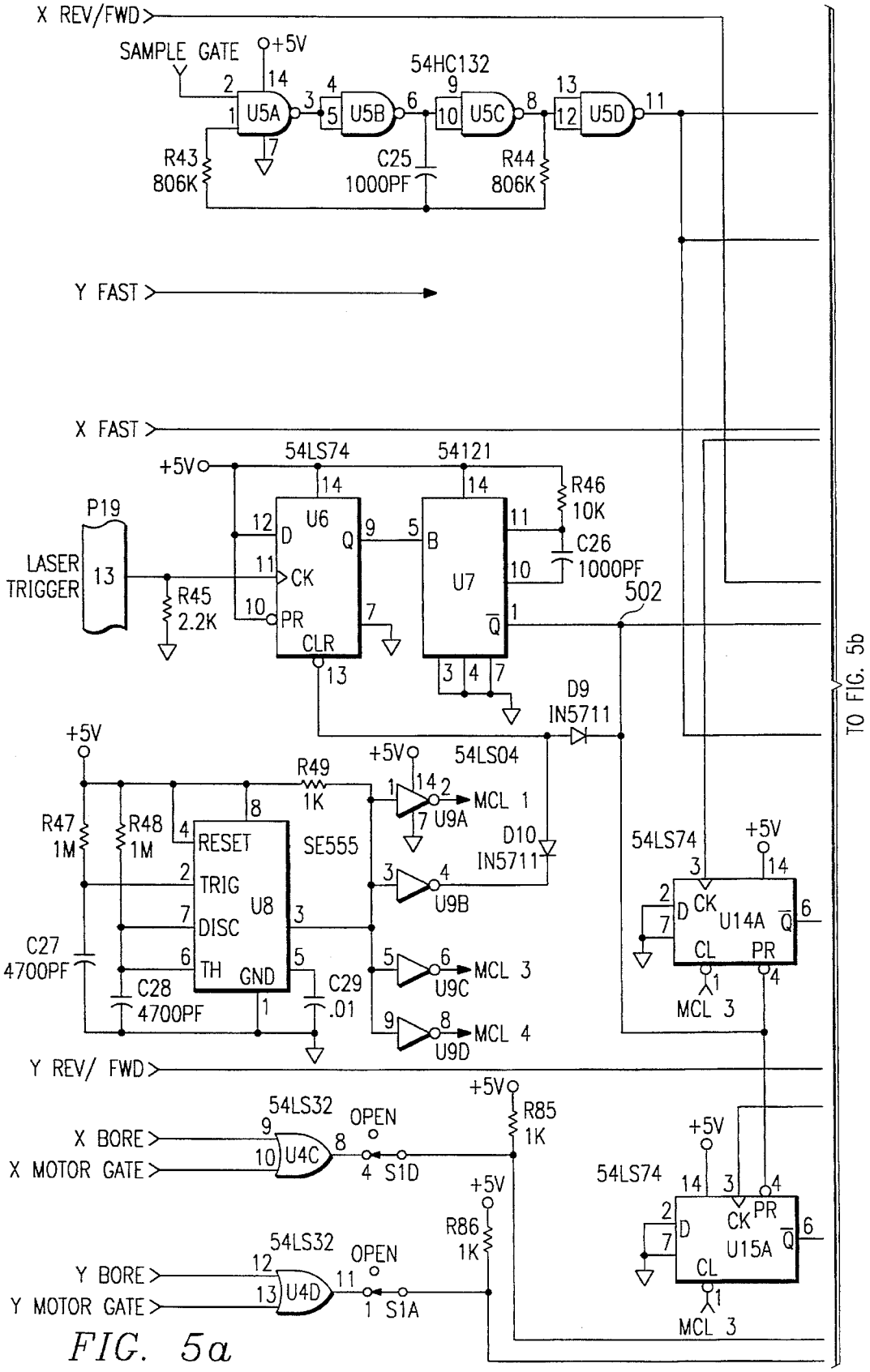
FIG. 5 illustrates an electrical schematic circuit diagram of the motor logic and trigger generator stages shown in FIG. 1.
Figure 5B:
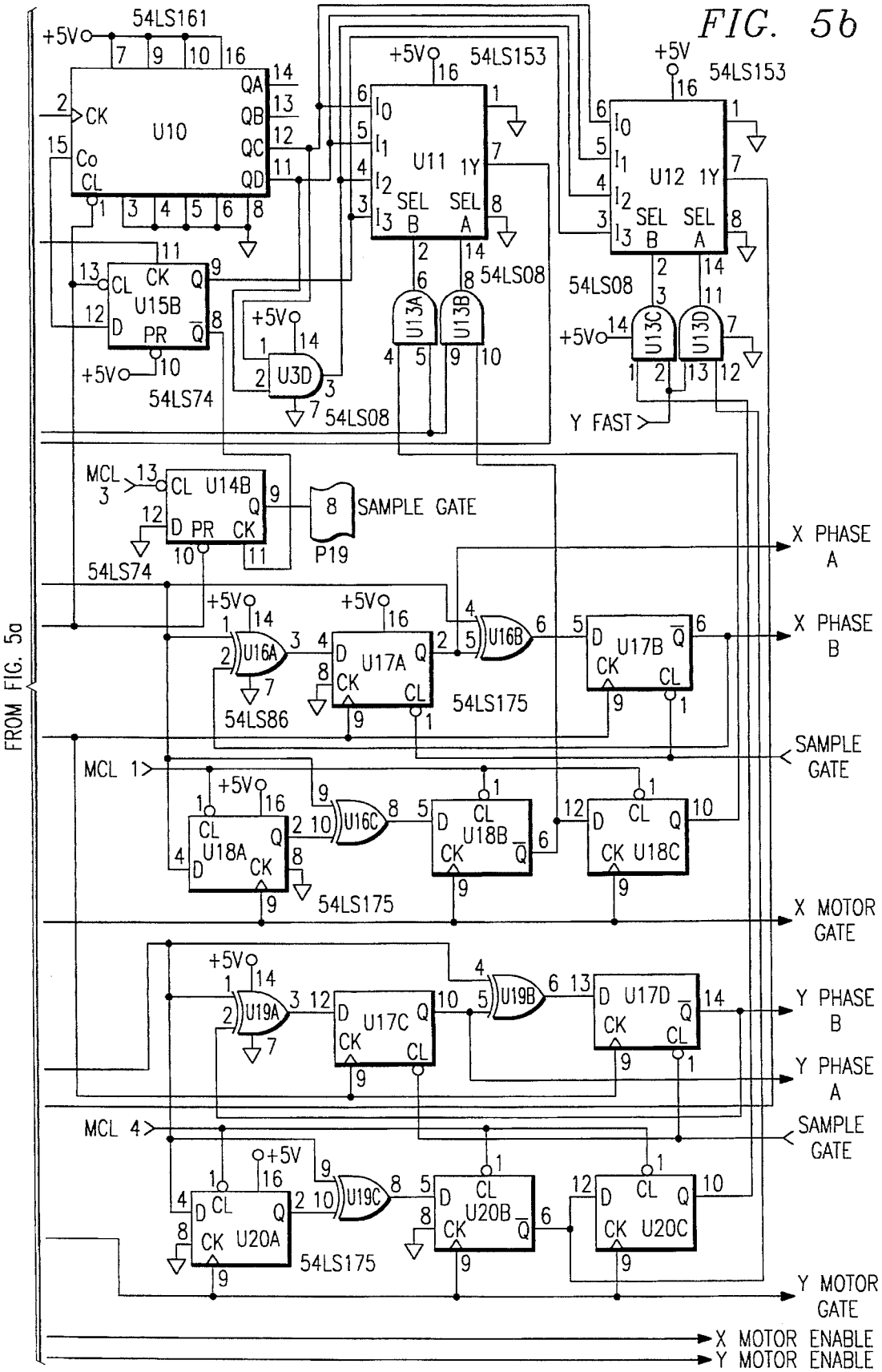

FIG. 5 illustrates an electrical schematic circuit diagram of the motor logic and trigger generator stages shown in FIG. 1(*a*). Generally, the trigger pulse generated by the sample and hold circuits is used to activate timing circuits in motor logic stage 124. Timing the drive operations in this manner ensures that the motor drive positioning signals will be applied to the optical wedge drive motors only after the laser has fired, thus synchronizing, and minimizing errors in, the movement of the wedges. Specifically, to activate the timing circuits, the laser trigger pulse generated at the output of amplifier U7 in FIG. 3, is coupled to the clock input of flip flop U6. The Q output of flip flop U6 is coupled to the B input of flip flop U7. The negated Q output of flip flop U7 is coupled to the negated reset inputs of flip flops U14A, U14B and U15A. The Q output of flip flop U14B provides the aforementioned 42.5 millisecond sample gate pulse, which is used to clock the logic circuits used for controlling the drive motors. The resulting sample gate pulse is also coupled to the negative signal input of amplifier U7 in FIG. 3. This sampling gate, which has an inherent delay time greater than 20 nanoseconds relative to the trigger pulse, is used to blank trigger generator stage 130 for a period of 42.5 milliseconds. This blanking operation thus inhibits any stray noise from generating false triggers.

The X REV/FWD positioning signal from comparator 122 is coupled to one input of XOR gate U16A, U16B, U16C, and the D input of flip flop U18A. The X FAST signal is coupled to one input of AND gates U13A and U13B, and the Y FAST signal is coupled to one input of AND gates U13C and U13D. The Y REV/FWD signal is coupled to circuitry that is virtually identical in structure and operation to the circuitry used to process the X REV/FWD signal.

The X boresight signal is coupled to one input of 0R gate U4C, and the Y boresight signal is coupled to an input of OR gate U4D. The negated Q output of flip flop U14A (X MOTOR GATE) is coupled to the second input of 0R gate U4C, and the negated Q output of flip flop U15A (Y MOTOR GATE) is coupled to the second input of OR gate U4D. The Q output of flip flop U17A is coupled to the second input of XOR gate U16B and also provides the output signal X PHASE A. The negated Q output of flip flop U17B is coupled to the second input of XOR gate U16A and also provides the output signal X PHASE B.

The Y positional logic is provided in a similar configuration, whereby the Q output of flip flop U17C is coupled to the second input of XOR gate U19B, and also provides the Y PHASE A output signal. The negated Q output of flip flop U17D is coupled to the second input of XOR gate U19A, and also provides the output signal Y PHASE B. The output of OR gate U4C provides the X MOTOR ENABLE output signal,and the output of OR gate U4D provides the output signal Y MOTOR ENABLE.

Figure 6A:
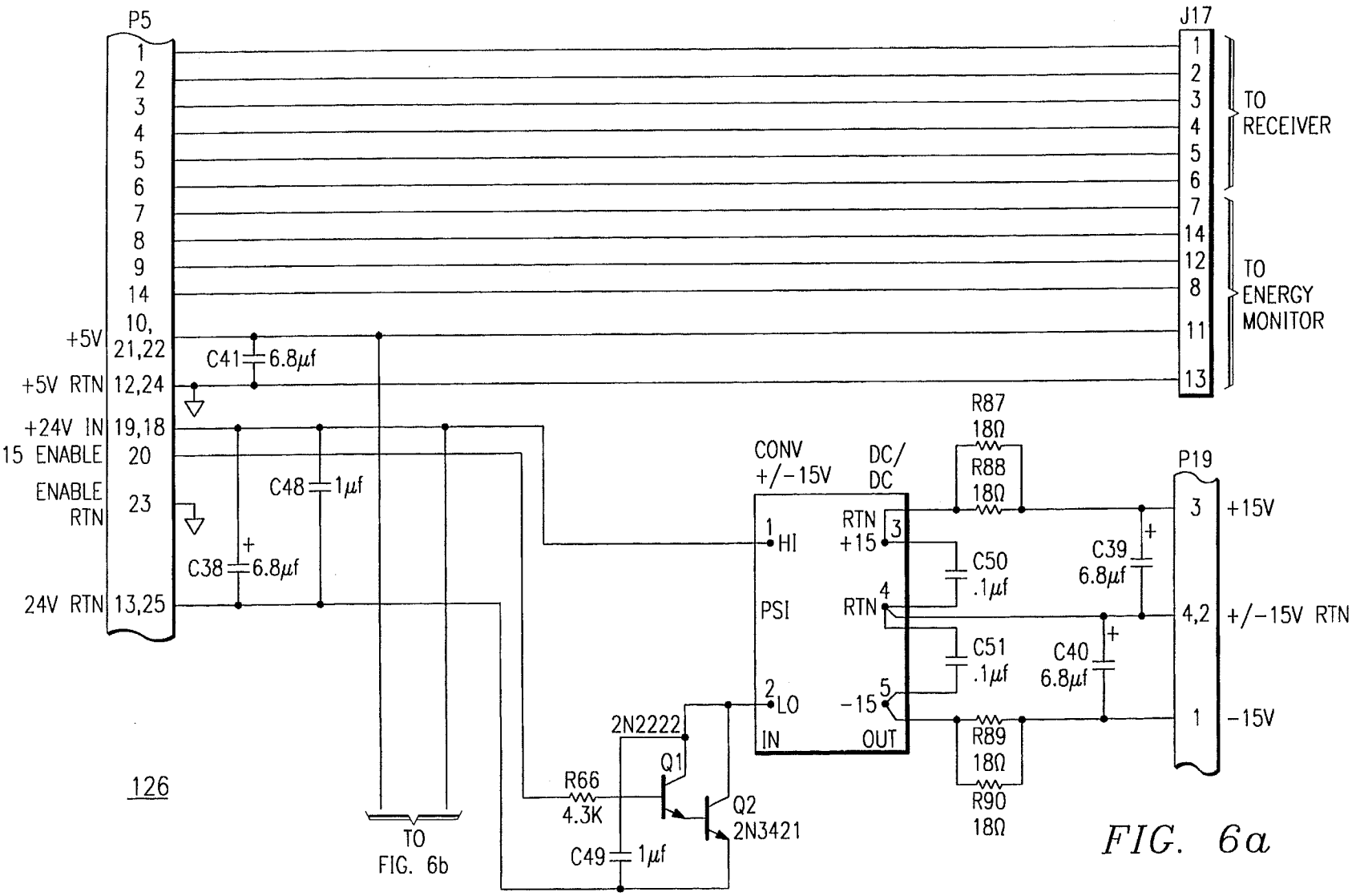
FIG. 6 illustrates an electrical schematic circuit diagram of the motor drive stage shown in FIG. 1.
Figure 6B:
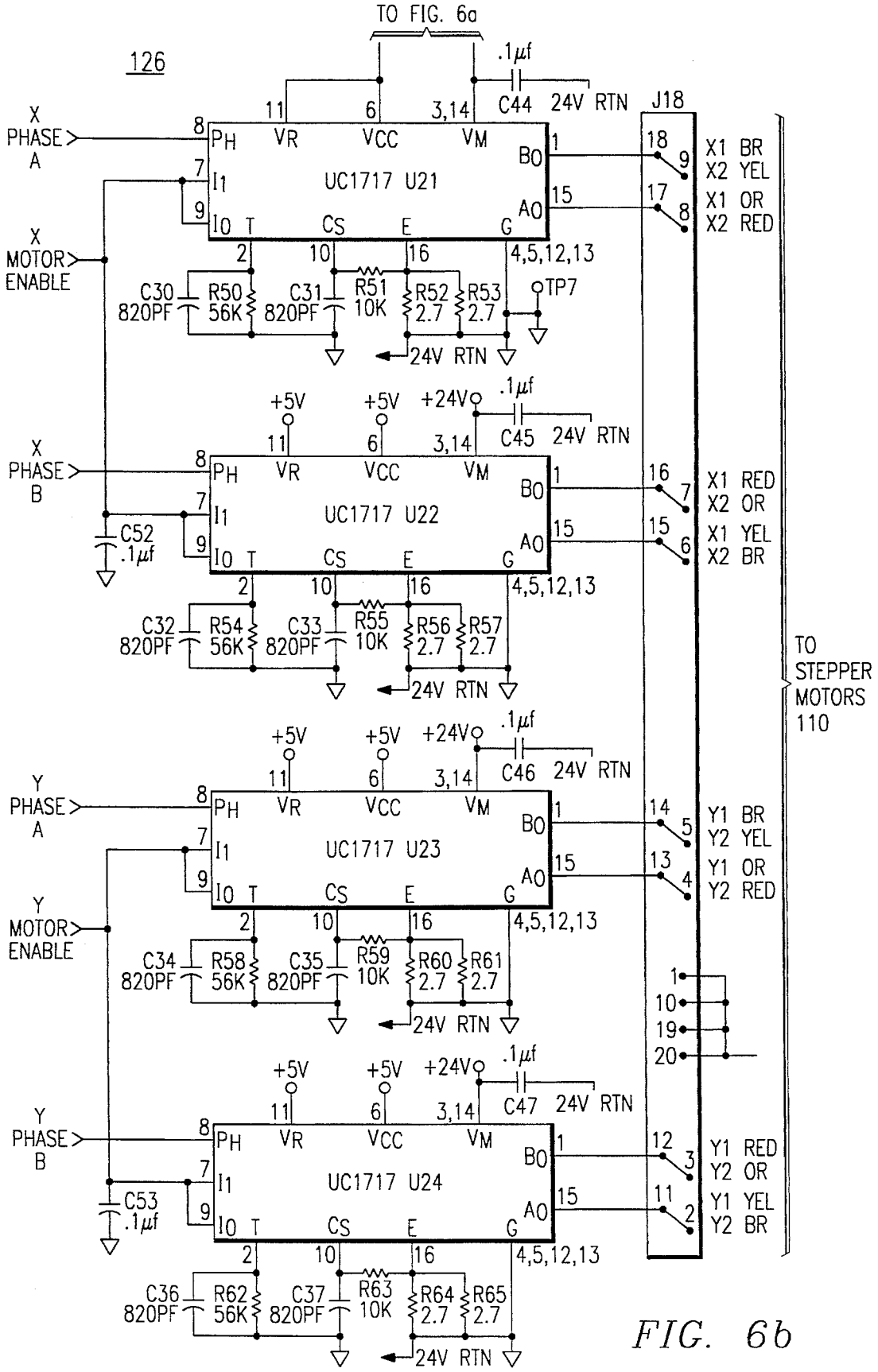

FIG. 6 illustrates an electrical schematic circuit diagram of the motor drive stage shown in FIG. 1(*a*). Essentially, one UC1717A stepper motor drive integrated circuit, manufactured by Unitrode, is provided for two of stepper motors 110 in FIG. 1(*a*). In the preferred embodiment, each integrated circuit drive chip is rated at 1A. Each chip provides drive current for two drive motors. For example, chip U21 may provide drive current to position one of a pair of wedges in one x direction, while counterpositioning the second wedge of the pair in the opposing x direction. In that case, chip U22 may drive the same pair of wedges, but each wedge is driven in an opposite direction relative to the other. As discussed above, in order to guide the laser beam l2, the wedges in each pair are counter-rotated with respect to the other.

Specifically, the X PHASE A signal may be coupled to the phase input of stepper motor IC U21, and the X PHASE B signal may be coupled to the phase input of IC U22. The X MOTOR ENABLE signal may be coupled to the current control inputs of IC's U21 and U22. Similarly, for the Y positioning signals, the Y PHASE A signal may be coupled to the phase input of IC U23, and the Y PHASE B signal may be coupled to the phase input of IC 24. The Y MOTOR ENABLE signal may be coupled to the current control inputs of IC's U23 and U24. The current signals to drive stepper motors 110 (FIG. 1(*a*)) may be provided at the A and B outputs of respective IC's U21–U24.

In operation, when laser source 104 is fired, beam l1 passes through the two pairs of optical wedges in assembly 106 to form deflected beam l2. The amount that beam l2 may be angularly offset from the radial axis of beam l1 is determined by the positions of wedges 106. One pair of wedges may be operable to position the laser beam in a horizontal (x) direction, and the other pair may position the beam in a vertical (y) direction. The light energy in beam l2 is split into at least two parts (beams l4 and l5) by optical prism 109. Approximately 99% of the light energy from beam 2 is passed through the prism as beam l4, while the other approximately 1% of the energy is reflected as beam l5. Approximately 2% of the light energy in beam l5 is reflected in beam splitter 108 and passed through as beam l3. Consequently, depending on the positions of wedges 106, beam l3 will impinge on quad detector 112 at a particular location.

Quad detector 112 generates current signals in each of channels A–D, which are proportional to the amount of light energy detected in each quadrant. For illustrative purposes only, FIG. 2 shows a portion of beam l3 being detected by photodetector 112A, while in reality, some portion of the light energy from beam l3 may be detected by more than one photodetector 112A–D. For example, if beam l3 were to be perfectly centered in the quad detector, then ¼ of the light energy (theoretically) would be sensed by each detector 112A–D, and the magnitudes of the current signals generated in all channels A–D would be equal. If, however, the beam spot were to be perfectly centered on the axis between quadrants A and B, but far removed from the axes with quadrants C and D, then (theoretically) ½ of the light energy would be sensed by each of detectors A and B, the current signals generated in channels A and B would be equal, and the current signals generated in channels C and D would be zero. The current signals from detectors 112A–D are amplified and converted to voltage signals in respective transimpedance amplifiers U1–U4, and coupled to the respective inputs of pulse amplifier stage 116.

Prior to operating system 100 in accordance with the invention, a preferable procedure used is to align the laser beam mechanically to coincide with the boresight axis. First, using any conventional, mechanical optical alignment technique, the boresight optics are aligned with the target area to be viewed. Then, the laser beam is mechanically aligned with the boresight so that the target area to be viewed is also illuminated accordingly by the laser beam. Once the laser beam is mechanically aligned and oriented properly with the boresight axis, system 100 functions automatically to maintain that alignment in accordance with the present invention.

Further orienting the system, optical wedges 106 are initially preset to allow laser beam 1 to pass through undisturbed. Then, subsequent to the initial alignment of the laser beam to the boresight axis, but still prior to providing automatic boresight alignment, the undisturbed beam is physically aligned (preferably by moving prism 109 and beam splitter 108) so that beam l3 impinges directly on the center of quad detector 112 once the boresight is physically aligned with the laser beam, which produces equal signals (i.e., no angular error) in channels A–D.

Subsequent to the above-described initial, alignment of the laser beam with the boresight axis, system 100 then functions automatically to maintain the position of the laser beam. Specifically, in accordance with a preferred embodiment of the invention, each time laser 104 (FIG. 1(*a*)) is fired, a relatively small portion of the laser beam is directed, as beam l3, to quad detector 112. The quad detector generates current signals in detectors 112A–D, which are proportional to the magnitude of the laser energy detected in each respective quadrant A–D. The current signals from detectors 112A–D are converted to voltage signals by respective wide-bandwidth operational amplifiers U1–U4 (FIG. 2), which are configured to operate in a transimpedance mode. As described above, these high impedance amplifiers U1–U4 are mounted in close proximity to quad detector 112, in order to minimize front end noise pickup and associated system errors. The voltage signals output from amplifiers U1–U4 are amplified in pulse amplifier stage 116 and coupled to sample and hold stage 118. Since the laser's pulse width is only 17 nanoseconds, the sample and hold stage stores each pulse and provides a gate of about 42.5 milliseconds for each channel A–D to process its respective signal. Importantly, the motor logic circuitry develops the sampling gate, which synchronizes the signal processing and error correction circuits in each channel A–D, directly from the laser pulse. Consequently, system 100 avoids the conventional technique of generating a special synchronization pulse for sampling, along with avoiding associated circuit complexity and attendant costs.

Referring to FIG. 3, potentiometers R85, R87, R89 and R91 may be adjusted to balance the gains of respective channels A–D. In a preferred embodiment, the gain of each channel A–D may be set, for example, to provide a maximum of 3 volts peak at the source of each FET Q1–Q4, when all of the laser energy is directed at, and detected in, that respective quadrant A–D of quad detector 112. The drive signal used to gate FETs Q1–Q4 is developed in pulse summer and amplifier stage 128, by summing the output signals from each transimpedance amplifier and a DC offset compensation voltage developed across potentiometer R93. The resulting summed signal is amplified at U7 and clipped by diodes D1 and D2 to provide a positive-going pulse of duration just under the 17 nanosecond pulse width of the laser. The gain of amplifier U7 is set so that the positive-going pulse has a peak magnitude of 5 volts. Preferably, the magnitude of the positive-going pulse applied to the gates of the sampling and hold FETs Q1–Q4 is thus maintained at that level independently of the signal levels developed in each channel A–D (i.e., independent of the laser beam's position). During each 42.5 millisecond gating or processing period between laser pulses, the sum and difference of the signals developed in channels A–D are output from amplifiers U25A–D and compared at comparator amplifiers U1A–D and U2A–D (FIG. 4). The resulting analog signals (their relative magnitudes representing the position of the laser beam with respect to the detector's quadrants) are then converted to a digital format using logic gates U3A–C and U4A–B.

Generally, the positional information from the comparator amplifiers indicates whether the laser beam spot is pointed above or below the X (horizontal) axis of quad detector 112, to the right or left of the Y (vertical) axis, touching either axis, very close to either axis, or directly at the center (i.e., at boresight) of the quad detector. This positional information may be derived from a comparison of the relative amount of light energy detected in each quadrant of detector 112, which is further represented by the relative magnitudes of the signals being processed in channels A–D. If the beam spot is not "touching" any axis, then an appropriate X FAST and/or Y FAST signal may be output from comparator stage 122, to cause the respective stepper motors 110 to step at their fastest rate. If, however, the beam spot is "touching" an axis, the appropriate stepper motors 110 which drive in that horizontal or vertical direction are caused to step at the slowest rate (i.e., no X FAST or Y FAST signal is output from comparator stage 122).

If the beam spot "crosses" an axis of quad detector 112, the respective comparators for that direction "fire" and a "reverse direction" signal is output from the comparator to the stepper motors for that direction. For example, if the beam spot crosses the X axis, then comparator U1B "fires" and an X REV/FWD signal is output to motor logic stage 124, which operates to reverse the drive direction of the horizontal stepping motors. Similarly, comparator U1D would fire to reverse the direction of the Y stepper motors, if the beam spot were to cross the Y axis. Preferably, using the above-described technique, system 100 compensates for any positional error by returning the beam to the origin of both axes (i.e., reacquiring boresight). Some hysteresis is designed into the comparator circuitry so that system "noise" will not trigger movement of the stepper motors.

If the beam spot is pointed directly at an axis (e.g., stopped on the X axis), then a corresponding pair of comparators would fire (e.g., both U1A and U1B would fire indicating a signal balance in the X direction) and the appropriate BORE signal (X BORE in the example) would be output to the motor logic stage. If the beam spot is pointing directly at boresight, then the corresponding pairs of X and Y comparators U1A–B and U1C–D would all fire indicating a signal balance in the X and Y directions (i.e., the signals in channels A–D are "equal"). Consequently, the X and Y BORE logic signals would be applied to AND gate U3C, which would, in turn, output a BORESIGHT OK signal to indicate that the angular displacement error is zero, and the laser beam has been realigned with the boresight axis.

Referring to FIG. 4, motor logic circuity 124 uses the positional information derived from the comparator circuits to generate drive commands for the stepper motors. The motor logic circuitry operates to allow the stepper motors to step at a rate of at least one of 8, 4, 2 or 1 increments per laser pulse, depending on the relative position of the beam spot. For example, assuming that the beam spot is positioned in the left half of the quadrant, closer to the Y axis than the X axis, and only detector 112A is outputting a signal. Motor logic circuitry 124 would then command the X and Y stepper motors to move at a rate of 8 increments per laser pulse. In response, the beam spot would be adjusted by the optical wedges to approach boresight (the intersection of the X and Y axes) at a 45° angle, thereby traversing the B quadrant. Then, during the next 42.5 millisecond processing cycle, the X motors would be directed by the motor logic circuitry to reverse and only move 4 increments. The Y motors would be directed to continue to move at a rate of 8 increments per pulse.

At the end of the second processing cycle, the beam spot should be "touching" the Y axis and the X motor rate would then be changed to one increment per pulse. Soon, the beam spot would be positioned very close to the Y axis and the X motors would then be disabled. The Y motors would continue to step the beam spot down the Y axis at 8 increments per pulse, until the X axis is crossed. At this point, the Y stepper motors would be reversed and the stepping rate accordingly reduced. The Y motors' movement would then continue at the slowest rate until boresight is reached. At boresight, the Y motors are then disabled.

An application of the present system for automatically correcting boresight errors in a laser beam guidance system is in laser rangefinder/designator systems. In accordance with the teachings of the present invention, system 100 operates to detect the position of the laser beam after the laser has fired and automatically correct for boresight error. An incremental correction is made during the time period between two laser pulses. When the laser beam of the present system is very close to boresight, the incremental correction needed is less than the minimum resolution requirements of the system. The correction is made by stepper motors (described below), which drive the two sets of optical wedges (described below) that are located in the optical system of the output laser beam. Thus, synchronization of the system is started by a laser pulse, and the incremental correction performed by the stepper motors is completed before the start of the next laser pulse. This operation may be illustrated by the system timing waveforms illustrated in FIG. 7 and described in detail below.

Referring to FIG. 5, when system 100 is first turned on, a plus 5 volts is applied to gate generator U8. Gate generator U8 generates a plurality of negative gates (MCL or "master clear") to clear the flip flops in FIG. 5 and ensure that the system is initialized to a known state. Motor logic circuitry 124 (and system 100) is now waiting for the first laser pulse. Note that none of the timing waveforms shown on FIG. 7 are generated before the first trigger pulse is applied.

The laser trigger pulse developed at the output of the pulse summer and amplifier stage (J19, pin 13 in FIG. 3) is used to synchronize the error correction operations of system 100. Referring again to FIG. 5, the laser trigger pulse is used to clock flip-flop U6, which in turn, clocks flip-flop U7, which provides a 7 μsec negative preset gate at node 502. The preset gate is applied to the preset input of flip-flop U14B which starts a 42.5 millisecond positive-going sample gate at the Q output. The preset gate is also applied to the preset inputs of flip-flops U14A and U15A to start the X and Y motor gates, which are provided at the respective negated Q outputs, and further to the clear input of binary counter U10. An oscillator comprised of logic gates U5A–D is turned on by the leading edge of the sample gate. The output of the oscillator (connection 11 of U5D) is applied to binary counter U10 and each of the logic circuits that generate the phase signals (X PHASE A and B, Y PHASE A and B) to control the stepper motor ICs and, consequently, the stepper motors (discussed below). The duration of the sample gate is such that the oscillator circuitry is cut off when binary counter U10 reaches a count of 17. The negative-going lagging edge of the sampling gate is then used to reset the motor logic circuitry in preparation for the next laser pulse and 42.5 millisecond processing cycle. The outputs of binary counter U10 are coupled to the inputs of respective X and Y multiplexers U11 and U12. The output of each multiplexer U11 and U12 is used to set the respective X and Y logic circuitry, which accordingly selects the width of the X or Y motor gate. The width of the X or Y motor gate determines the number of increments per laser pulse the respective stepper motors will move.

Referring to FIG. 6, stepper motors 110 (FIG. 1(*a*)) are driven by conventional ICs, each of which has been designed to control and drive the current in one winding of a respective bipolar stepper motor. Each IC chip (U21–24) contains an LS-TTL compatible phase logic input stage and a bridge-configured output stage. Internal to the IC, a voltage divider and three comparators provide control signals for the motor current drive circuits, and two logic inputs to provide digital current level selections. Two sets of optical wedges 106 (i.e., four wedges) are required to position the laser beam, with one motor being used to drive each wedge. Therefore, each IC is used to control one drive motor. A conventional system would typically require 8 motor drive ICs. However, in system 100, since each wedge in a pair is counter-rotated with respect to the other, only one IC is needed to drive one coil in each motor, by properly selecting the drive polarities.

Figure 7:
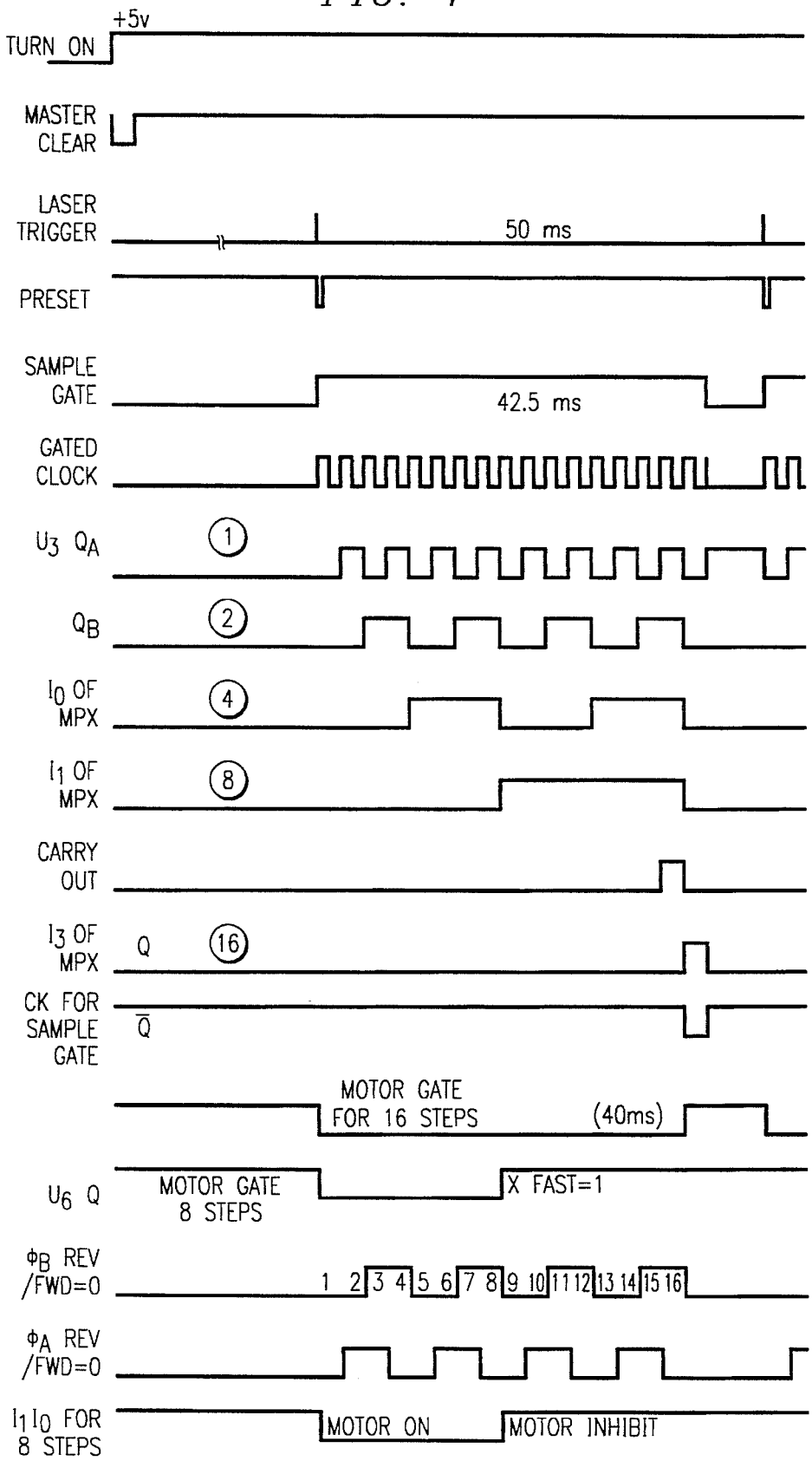
FIG. 7 illustrates representative voltages from the timing and logic circuitry of the present invention.

Generally, FIG. 7 illustrates representative voltages from the timing and logic circuitry of the present invention. Referring to FIGS. 6 and 7, the preferred embodiment of the present invention utilizes four steps of a 1.8 degree stepper motor 110, to achieve a resolution of 7.2 degrees. The two phase stepper motors 110 may be stepper motors having the part number 11-SHBD-45AB, which are manufactured by Clifton Precision Division of Litton Industries. Each of the two motor windings are driven by square waves ($\phi_A$ REV/FWD and $\phi_B$ REV/FWD) having a period of 10 milliseconds and being 90° out of phase with one another. The leading phase determines a motor's direction of rotation. For the $\phi_A$ and $\phi_B$ polarities shown in FIG. 7, a stepper motor would rotate in a reverse direction. During each 10 millisecond period, four logic pairs of phase signals would be generated that would drive a stepper motor four steps of 1.8 degrees per step, or a total of 7.2 degrees. The number of incremental movements of a motor (based on four steps per increment) needed for error correction during the 50 millisecond period between laser pulses, is based on the width of the negative-going motor gate that is applied to the current control input of the appropriate stepper motor drive (UC1717) integrated circuit.

Although the present invention and its advantages have been described in detail, it should be understood that various changes, substitutions and alterations can be made herein without departing from the spirit and scope of the invention as defined by the appended claims.

What is claimed is:

1. A system for automatically maintaining the position of a laser beam relative to a boresight axis, comprising:

a first beam guidance apparatus comprised of a first plurality of optical wedges operable to position said laser beam in a horizontal direction in response to a first error signal;

a second beam guidance apparatus comprised of a second plurality of optical wedges operable to position said laser beam in a vertical direction in response to a second error signal;

a beam detector circuit operable to detect the position of said laser beam relative to said boresight axis; and error signal generation circuitry coupled to an output of said beam detector circuit and operable to generate said first and second error signal responsive to an angular displacement of said laser beam from said boresight axis.

2. The system of claim 1, wherein said beam detector circuit includes a plurality of semiconductor photodetectors.

3. A method of automatically maintaining the position of a laser beam relative to a boresight axis, comprising the steps of:

detecting the position of said laser beam relative to said boresight axis;

generating a first error signal responsive to an angular displacement of said laser beam from said boresight axis in a horizontal direction;

generating a second error signal responsive to an angular displacement of said laser beam from said boresight axis in a vertical direction;

positioning said laser beam in a horizontal direction in response to said first error signal and in a vertical direction in response to said second error signal by positioning a first and second plurality of optical wedges.

4. The method of claim 3, wherein the step of positioning comprises rotating a plurality of optical wedges.

5. A system for automatically maintaining the position of a laser beam relative to a predetermined axis, comprising:

beam detector circuitry operable to detect the position of said laser beam relative to said predetermined axis;

preamplifier circuitry connected in close proximity to an output of said beam detector circuitry and operable to amplify a plurality of position signals received from said beam detector circuitry while minimizing front end noise;

error signal generation circuitry operable to generate an error signal responsive to at least one of said plurality of position signals; and beam guidance apparatus which includes a first and second plurality of optical wedges operable to position said laser beam responsive to said error signal.

6. The system of claim 5, wherein said beam detector circuitry comprises a plurality of semiconductor photodetectors.

7. The system of claim 5, wherein said beam detector circuitry comprises a quad detector circuit.

8. The system of claim 5, wherein said error signal generation circuitry includes sum and difference amplifier circuitry and comparator circuitry.

9. The system of claim 5, wherein said beam guidance apparatus includes a plurality of motor driven optical wedges.

* * * * *